US005425171A

United States Patent [19]

Kroger et al.

[11] Patent Number: 5,425,171

[45] Date of Patent: Jun. 20, 1995

[54] METHOD OF MAKING INSERT RETENTION GAS TIGHT SEAL FOR ELECTRICAL PROTECTOR

[75] Inventors: Roy E. Kroger, Norco; Louis E. Spears, Rancho Cucamonga, both of Calif.

[73] Assignee: Matrix Science Corporation, Torrance, Calif.

[21] Appl. No.: 216,005

[22] Filed: Mar. 22, 1994

Related U.S. Application Data

[60] Division of Ser. No. 821,345, Jan. 13, 1992, Pat. No. 5,295,866, which is a continuation of Ser. No. 595,074, Oct. 9, 1990, abandoned.

[51] Int. Cl.[6] ..... H01R 43/02

[52] U.S. Cl. ..... 29/876; 174/89

[58] Field of Search ..... 29/874, 828, 876; 174/89

[56] References Cited

U.S. PATENT DOCUMENTS

| | | | |
|---|---|---|---|
| 2,989,784 | 6/1961 | Aamodt | 29/828 X |
| 3,373,243 | 3/1968 | Janowiak et al. | 174/89 |
| 3,646,502 | 2/1972 | Hutter et al. | 29/874 X |
| 4,059,330 | 11/1977 | Shirey | 29/874 X |
| 4,920,643 | 5/1990 | Wilson | 29/876 |

FOREIGN PATENT DOCUMENTS

| | | | |
|---|---|---|---|
| 1206968 | 2/1960 | France | 174/89 |

*Primary Examiner*—Carl J. Arbes

*Attorney, Agent, or Firm*—Robbins, Berliner & Carson

[57] ABSTRACT

An insert retention gas tight seal for an electrical connector is disclosed. The insert retention, gas tight seal includes an annular groove defined by the interior surface of the connector housing within the receptacle and the plug, an annular ring of soft metal, and a tool to force the ring into the annular groove into a sealing, locked position within the connector housing of the receptacle and the plug. A method of fabrication for the insert retention, gas tight seal for an electrical connector is also described.

3 Claims, 4 Drawing Sheets

FIG. 5
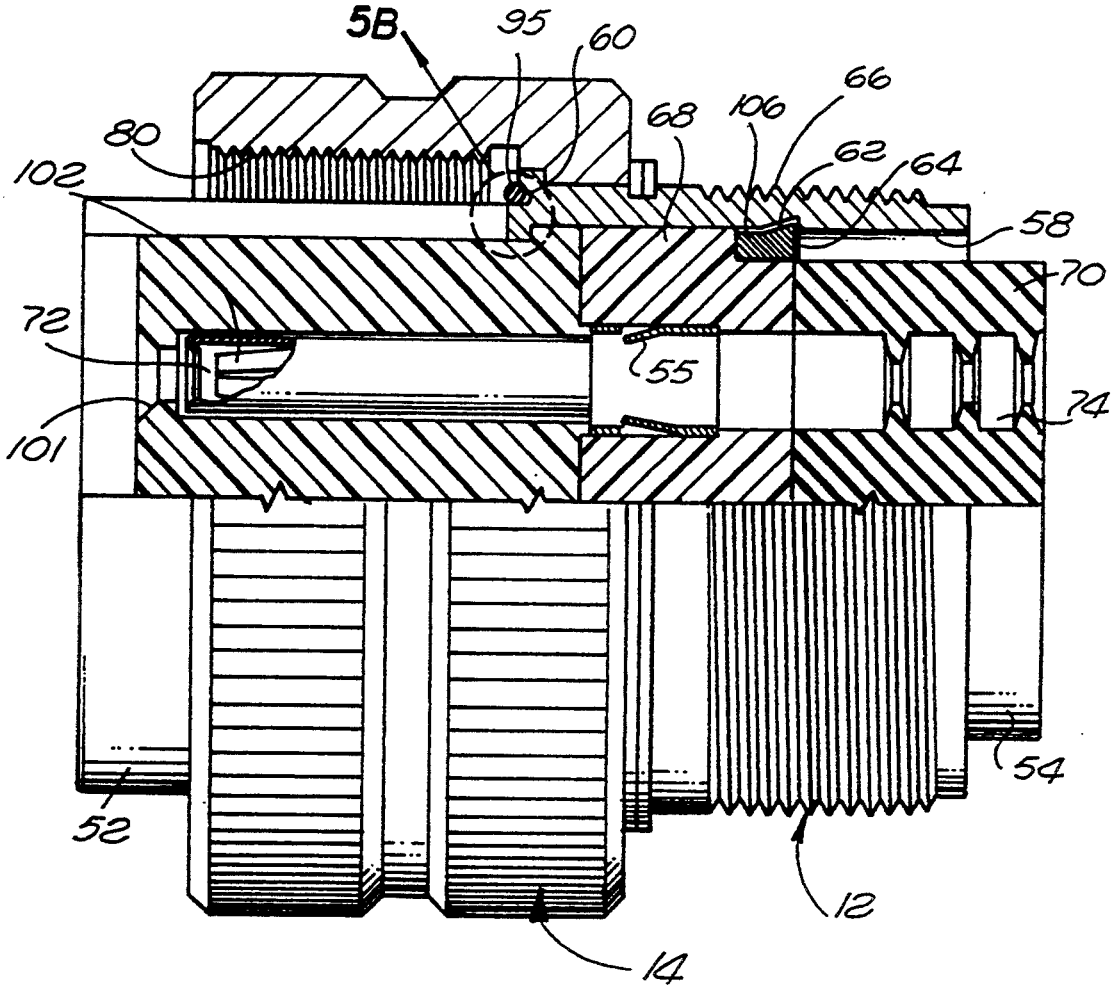
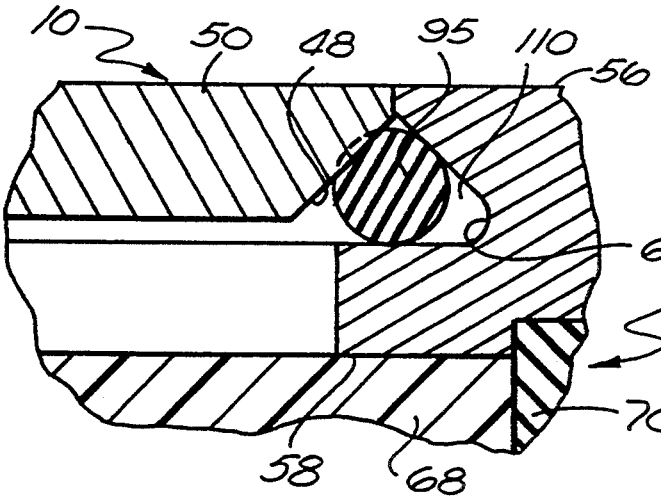
FIG. 5B

METHOD OF MAKING INSERT RETENTION GAS TIGHT SEAL FOR ELECTRICAL PROTECTOR

RELATED APPLICATION

This application is a divisional application of application Ser. No. 07/821,345, filed on Jan. 13, 1992, which will be issued as U.S. Pat. No. 5,295,866 on Mar. 22, 1994, which in turn is a continuation of application Ser. No. 07/595,074 filed on Oct. 9, 1990, which is now abandoned.

BACKGROUND OF THE INVENTION

The present invention relates to an insert retention, gas tight seal for an electrical connector and more particularly to a solid metal annular ring gas tight seal which becomes an integral part of the connector housing for both the receptacle and the plug.

Expanding ring retainers for use in electrical connectors which provide limited movement and limited vibration deterioration of the connector insert are known.

U.S. Pat. No. 4,099,323, issued Jul. 11, 1978 to A. J. Bouvier, entitled "Method of Making Electrical Connector", describes an electrical connector having a ribbon-like laminate deformed in the space between the connector shell and an insert member and between the connector shell and a wafer to maintain the insert member and the wafer assembled one to another within the shell.

As disclosed in the Bouvier patent, this insert member is a thin laminate which can be mechanically deformed until it substantially fills the space between the shell and the insert. The laminate member is made of a matrix of screen-like material, for example a wire screen, impregnated with an epoxy or other thermal setting material. Specific embodiments of the Bouvier device comprise a matrix material having a bronze screen.

U.S. Pat. No. 4,019,799, issued Apr. 26, 1977 also to A. J. Bouvier, entitled "Electrical Connector", discloses wrapping a deformable laminate around the members within an electrical connector housing and inserting the assembled members with the laminate into a shell thereby affixing the connector inserts immovable in this application. In the second patent to Bouvier, the laminate is a screen-like material impregnated with an epoxy. The Bouvier device describes a laminate deformed wherein it substantially fills the space including an annular groove within the insert of the housing. The laminate is deformed prior to the insertion of terminals using a pressure tool.

U.S. Pat. No. 4,703,987 issued Nov. 3, 1987 to David O. Gallusser et al. entitled "Apparatus and Method for Retaining an Insert in an Electrical Connector", describes a deformable plastic strip longitudinally deformed and slotted within a longitudinal column of an electrical connector. The Gallusser et al. patent discloses an annular groove on the inner wall and the dielectric insert having an outer periphery disposed within the connector shell so that an annular passageway is provided between the shell and the insert thereby providing a retention arrangement for retaining the insert in the shell.

Further, this insert retention member in the Gallusser et al. patent, incorporates an insert tool to insert and maintain the insert between the connector shell and the dielectric insert. The Gallusser et al. device incorporates the use of a dielectric material such as a plastic because of the conductive path which occurs between the insert assembly and the shell when a copper mesh epoxy laminate or metal ring staking is used.

Finally, U.S. Pat. No. 4,682,832, entitled "Retaining an Insert in an Electrical Connector", issued Jul. 28, 1987 to Stephen Punako et al., discloses a tubular sleeve of deformable plastic longitudinally slotted defining longitudinal columns having leading edges. The annular passageway formed between the connector insert and shell allows the longitudinal columns to collapse accordion style thereby radially wedging and locking in the columns in the passage and retaining the insert within the shell.

In the Punako et al. device, an electrical connector having a metal shell includes an annular groove within the interior wall of the shell, wherein the dielectric insert has an outer periphery disposed within the shell so that there is an annular passageway between the shell and the insert.

The Punako et al. retention arrangement includes a thermoplastic material retention member longitudinally slotted along its front face providing a plurality of axially weakened columns that terminate in a leading edge such that each column can curl back 180° upon themselves to lock the forward end portion of each respective column. Each axially weakened column is forward of the respective column medium portion such that each column is weakened to collapsibly fold and stack in accordion-like fashion forming radial folds. These columns are then curled and folded after the leading edges have engaged in an axial wall of the annular groove at the end of the passageway, and the curled folded column portions interface and wedge in the passageway around the annular passageway thereby retaining the insert within the shell.

It is a long held industry problem of the insulating insert moving within the electrical connector, thereby causing a deterioration of the insert and a loss of electrical interface connection due to the heavy vibration of equipment supporting the connectors.

Connectors which are necessary for use in heavy construction, for example, require a retaining system which can maintain the integrity of the connector insert without movement because movement of the inserts or deterioration of the inserts results in a misalignment of the fully mated connector.

SUMMARY OF THE INVENTION

This invention provides an insert retention, gas tight seal for an electrical connector having a housing including, a receptacle, plug and coupling nut, wherein the receptacle and plug each have an insulating insert which resides within the electrical connector housing or shell. Annular grooves are inscribed upon the interior surface of the electrical connector housing. Soft annealed metal cylindrical rings are inserted within the electrical connector housing for the receptacle and plug around the inserts, specifically within the annular grooves.

As an added and more specific feature, there is provided a cylindrical tool operable to, under high pressure, collapse and expand the soft annular metal cylindrical rings within the annular groove thereby providing a gas tight seal.

The present invention, an insert retention gas tight seal for an electrical connector, solves the problem of the vibrational deterioration of the insulating insert within an electrical connector as used in the construction industry for connectors subjected to high vibration.

Further, the invention provides an electrical connector insert retention system that can be provided in a high vibrational environmentally destructive arena guaranteeing the continued mating of the receptacle and plug without receptacle and plug insert degradation.

A method of fabricating an insert retention gas tight seal for an electrical connector is also disclosed.

BRIEF DESCRIPTION OF THE DRAWINGS

A complete understanding of the present invention, and of the above and other advantages and features thereof may be gained from a consideration of the following description of the preferred embodiments taken in conjunction with the accompanying drawings in which:

FIG. 5 is a schematic representation partial cross sectional view of the connector plug and coupling nut having insert view B; and FIG. 5B is a schematic representation partial cross sectional view of the secondary seal between the connector plug and the coupling nut of FIG. 5.

DETAILED DESCRIPTION OF THE PREFERRED EMBODIMENT

The invention, an insert retention gas tight seal for an electrical connector, comprises a standard electrical connector having a receptacle, plug and coupling nut which has annular grooves inscribed within the interior walls of the receptacle and plug. The inserts for the receptacle and plug are inserted by hand, and an annular aluminum or other soft metal annular ring is inserted surrounding the inserts between the interior surfaces of the receptacle and plug and the exterior surfaces of the inserts.

A beveled cylindrical tool is pressed against the soft metal annular rings under high pressure collapsing and expanding the soft metal into the inscribed grooves of the receptacle and plug interior surfaces. The combination of the inscribed grooves, the soft metal impressed within the grooves, and the receptacle and plug interior surfaces create a gas tight seal surrounding the inserts and a stable support for the inserts when they are subjected to high vibration.

Figure 1:
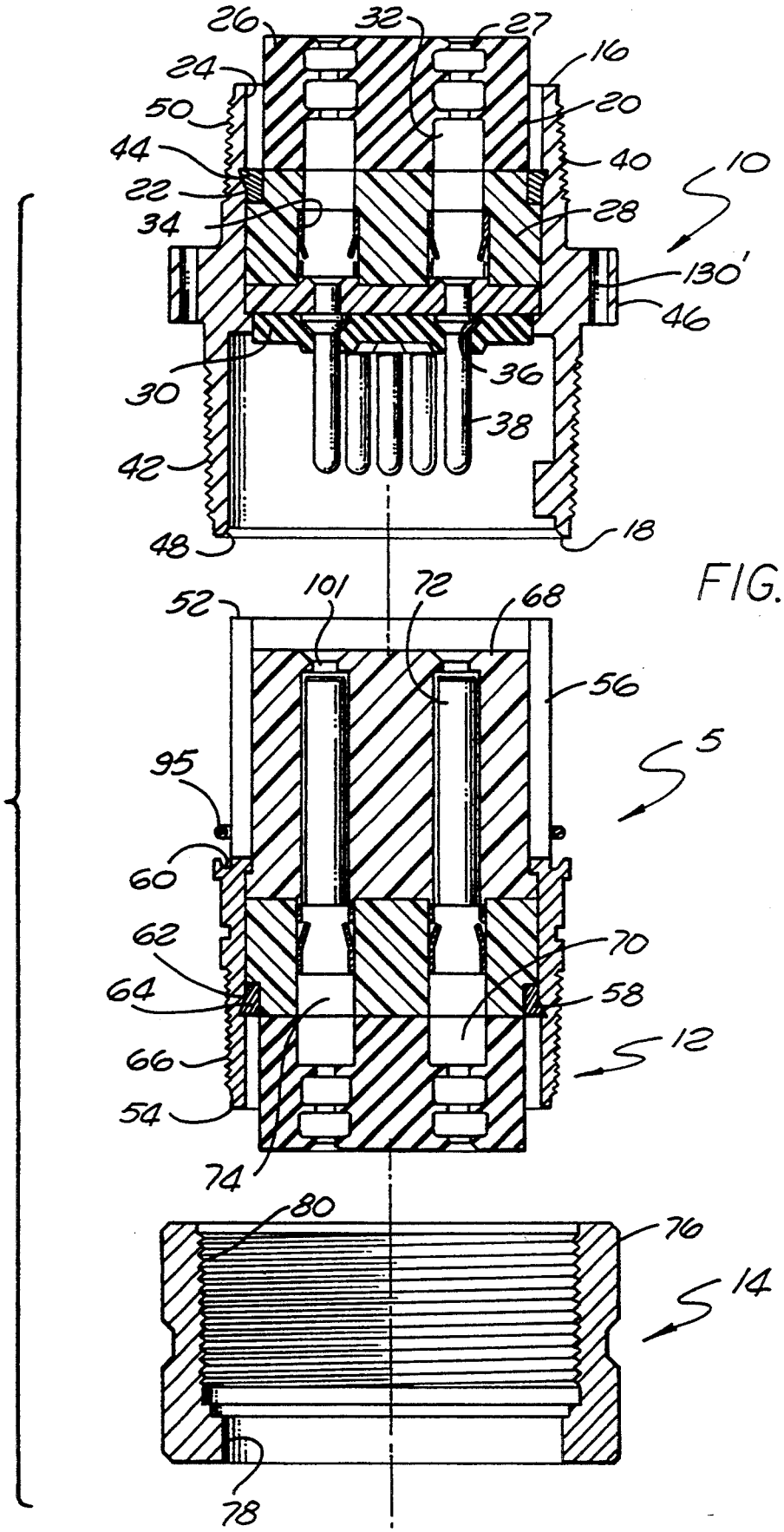
FIG. 1 is a schematic representation exploded cross sectional view of a connector receptacle, plug and coupling nut having an insert retention, gas tight seal.

FIG. 1, is a schematic representation exploded cross sectional view of a connector having a receptacle 9 plug, each incorporating an insert retention, gas tight seal. The connector 5 is shown here exploded in cross section and includes: a receptacle 10, plug 12 and coupling nut 14. The receptacle 10 has a top 16 and bottom 18 as viewed in FIG. 1. Protruding from the top 16 of the receptacle 10 is the first receptacle insert 26. This insert 26 has a plurality of orifices 27 adapted to receive wires (not shown) connected to the pins 38 as is well known in the art. First receptacle insert 26 rests upon a second receptacle insert 28. The interior surface 24 of the receptacle 10 is inscribed by an annular groove 22 at a point upon the interior surface 24 where the first insert 26 and second insert 28 are matingly joined. An annular insert retaining ring 44 is mounted within the inscribed groove 22. The annular insert retaining ring 44 of this example is soft annealed aluminum. A third receptacle insert 30 rests below and is joined with the second receptacle insert 28. Electrically conductive metal pins 38 protrude from the third receptacle insert 30. These metal pins 38 are operable to enter the orifices 101 of the plug 12 and mate with female contacts therein.

Wires (not shown) extend through the first receptacle insert 26 through orifices 27 and through the first receptacle insert cavities 32, second receptacle insert cavities 34 and third receptacle insert cavities 36 where they interconnect with the metal pins 38. A wall mounting flange 46 having two mounting orifices 130, 130' is operable to facilitate the wall mounting of the receptacle 10 to a fixed planar surface. The threads so formed on the interior surface 78 of the coupling nut 14 threadedly engage the threads 42 of the receptacle 10 to mechanically and electrically secure together the plug and receptacle. The beveled inner edge of bottom 18 of the receptacle shell defines an annular sealing means 48 which matingly engages the annular side flange 60 of the plug 12 when the receptacle 10 and plug 12 are connected. O-ring 95 serves as a primary seal between the receptacle 10 and plug 12.

As shown in FIG. 1, during connector mating, the top 52 of the plug 12 matingly interfits within the bottom 18 of the receptacle 10 such that the exterior surface of the plug 56 slidably interfits within the interior surface 24 of the receptacle 10, with key 43 extending along a corresponding keyway of the plug shell. The metal pins 38 of the receptacle 10 enter the holes 101 within the plug first insert means 68 and pass into the plug first insert cavities 72 to engage female electrical contacts (see FIG. 5) residing therein. Electrical wires (not shown) fastened to the female electrical contacts pass through the plug second insert 70 and through plug second insert cavities 74. The plug 12 has its interior surface 58 inscribed with an annular groove 62. An annular retaining ring 64 for the plug 12 provides insert 68 stability, and a gas tight seal for the plug 12. The coupling nut 14 lockingly engages the plug 12 and receptacle 10 when its exterior surface 76 is turned with threads 80 of ring 14 engaging with threads 42 of receptacle 10.

Figure 2:
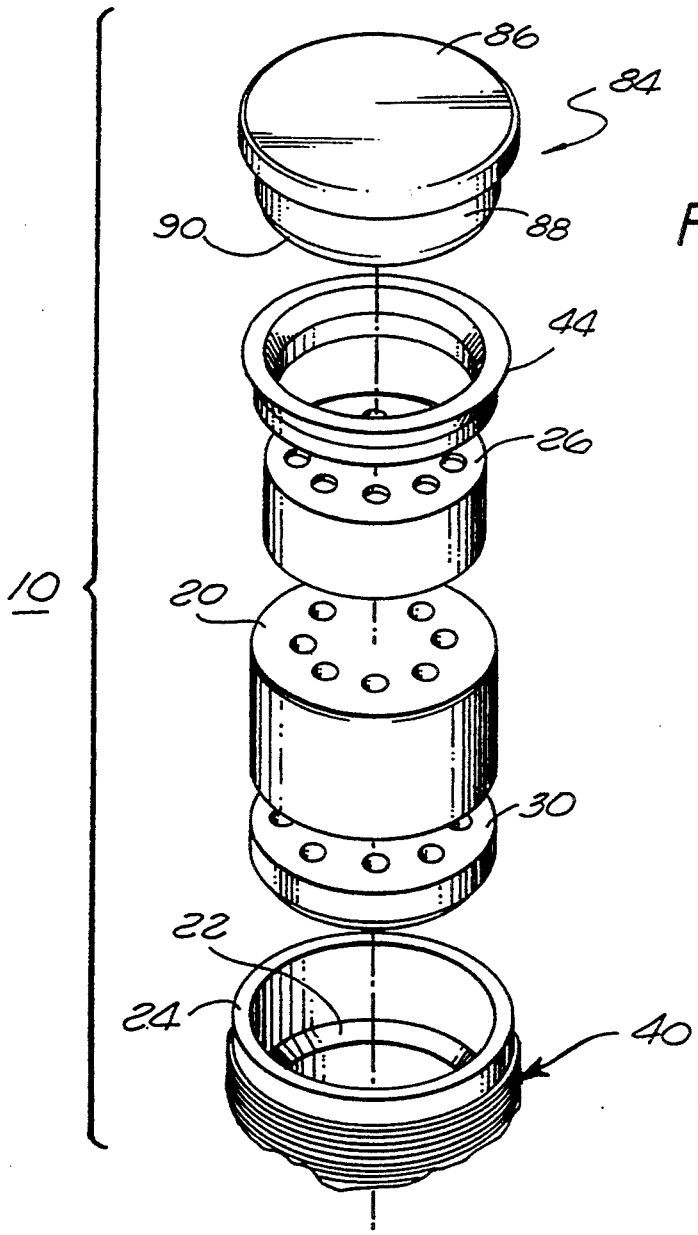
FIG. 2 is a schematic representation exploded orthogonal view of a tool pressing the insert retention receptacle annular ring into the annular groove.

FIG. 2 is a schematic representation exploded orthogonal view of the tool pressing in the receptacle annular retaining ring around the first insert of the receptacle. This process would be identical for the pressing of the annular ring in the plug 12 (not shown here). In the example of FIG. 2, the tool 84 having a flat top 86 which can be subjected to pressure, a shank 88 ending with a beveled edge 90 slidingly interfits between the outer surface of first insert 26 and the interior surface 24 of first receptacle 10. Annular ring 44 rests within an inscribed groove 22 within the interior surface 24 of the receptacle 10. This inscribed groove 22 is positioned upon the interior surface 24 of the receptacle 10 between the first insert 26 and the second insert 28. After the tool 84 is placed upon the annular ring 44 it is subjected to a force of between 100 and 150 psi. This force compresses the annular ring within the inscribed groove 22. This gas tight seal formed by the annular ring 44 is an integral part of the interior surface 24 of the receptacle 10. The gas tight seal also provides increased structural support to the inserts 26, 28.

Figure 3:
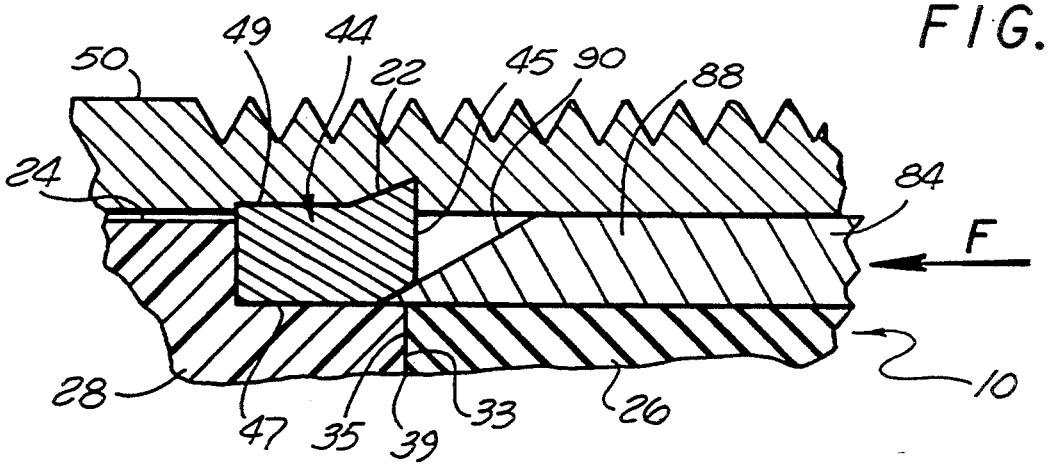
FIG. 3 is a schematic representation partial cross sectional view of the bevelled edge of the tool pressing in the insert retainer annular ring.

FIG. 3 is a partial cross sectional view schematic representation of the process of the tool 84 pressing in the annular insert retention gas tight seal. Specifically, the receptacle 10 has an annular groove 22 inscribed within the interior surface 24 of the receptacle 10. The annular ring 44 having an annular ring exterior surface 49 and an annular ring interior surface 47, resides within the annular groove 22. The interior surface 47 of the annular ring 44 is forced against the first 26 and second 28 inserts of the receptacle 10, while the exterior surface 49 of the ring 44 presses against the interior surface 24 of the receptacle 10 within the groove 22. When a force, F, in the range of 100 to 150 psi is applied to the annular ring 44 through the beveled edge 90 of the tool 84, the annular ring 44 and the receptacle 10 become one. The tip 45 of the annular ring 44 is forced within the groove 22 by the beveled edge 90 of the tool 84, facilitating a gas tight seal at the bonding point 39 of the first 26 and second 28 inserts; specifically, where the bottom 33 of the first insert 26 rests upon the top 35 of the second insert 28. First and second inserts of both the plug and receptacle connector are bonded together. Member 30 is bonded to the front of the forward insert.

Figure 4:
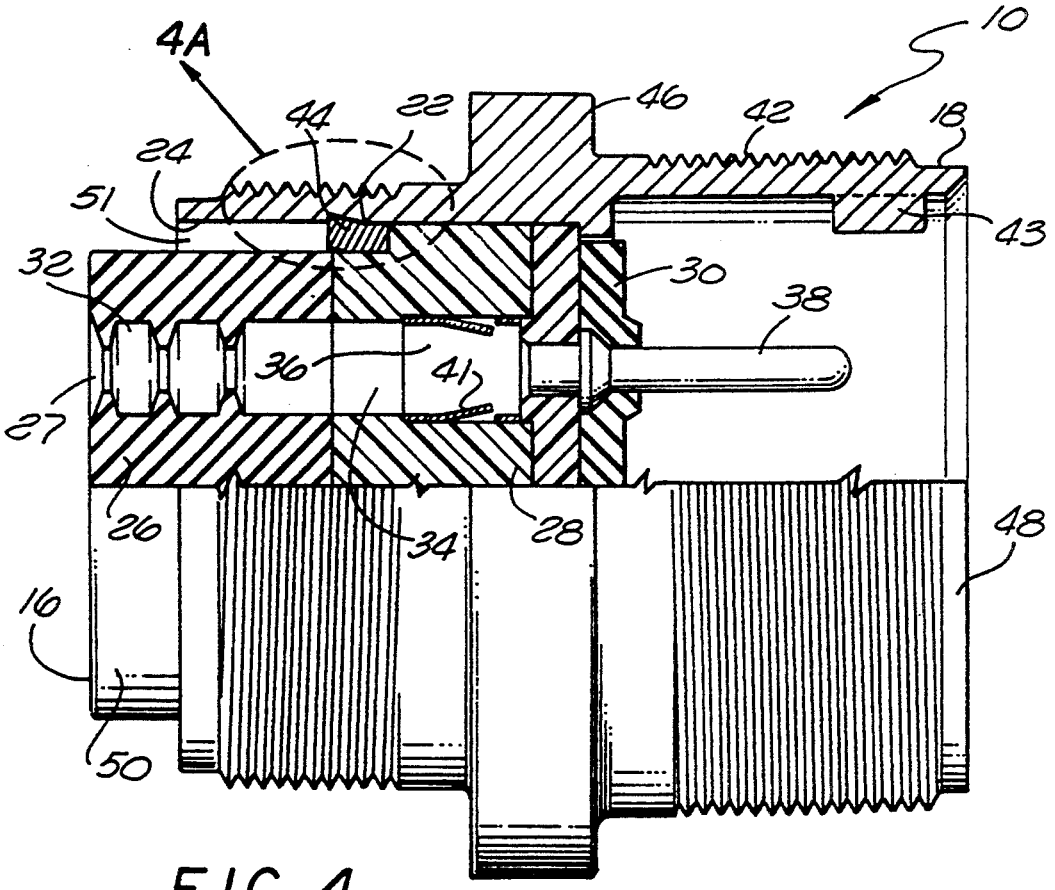
FIG. 4 is a schematic representation partial cross sectional view of the connector receptacle having insert view A.
Figure 4A:
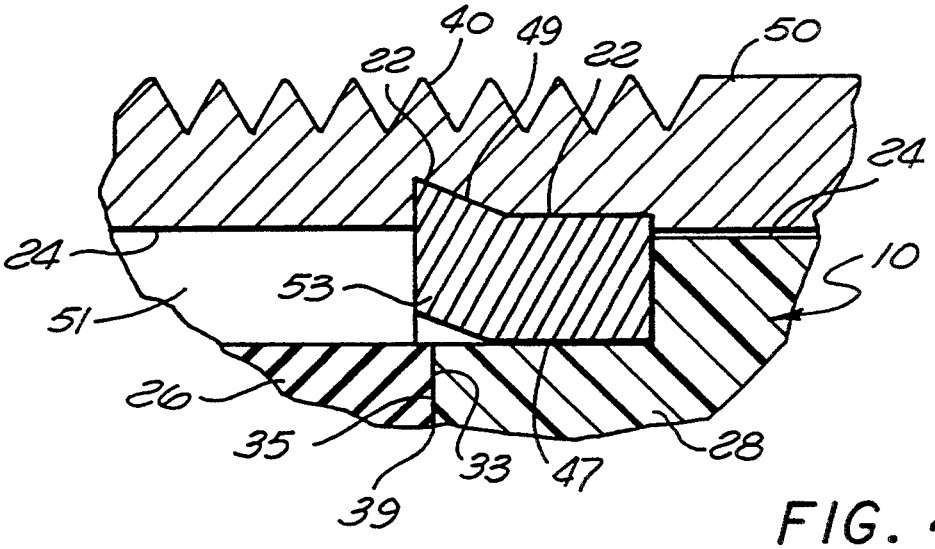
FIG. 4A is a schematic representation partial cross sectional view of the pressed in insert retainer annular ring.

FIG. 4 is a schematic representation partial cross sectional view of the connector receptacle while FIG. 4A is an enlarged view of the annular ring 46 forming the seal. As can be seen in FIG. 4, the receptacle 10 has an annular receptacle groove 22 inscribed within the interior surface 24 of the receptacle 10. An annular ring 44 is positioned between the interior surface 24 of the receptacle 10 and the exterior surface of insert 28. The top 16 of the receptacle 10 of the first insert 26 has a hole 27 operable to receive an electrical wire (not shown here) which would slide within the first insert cavity 32 and second insert cavity 34 and be electrically connected to the contact pin 38. Wires terminated with a soldered connection are terminated before the terminals are assembled to the inserts. The pin 38 is held in place within the third insert cavity 36 by a clip retaining means 41. As shown in FIG. 4 during connector mating the annular sealing means 48 at the bottom 18 of the receptacle 10 engages the annular sealing means 55 of the plug 14 (FIG. 5B) forming a seal. Conductor wires are clamped after insertion by reduced diameter portions of cavity portions 32 for mechanical vibration and seal support benefits. The second threaded 42 means of the receptacle 10 and key 43 with a corresponding keyway of the plug shell serve to align the receptacle 10 with the plug 12. The annular ring 44 provides a seal within the opening 51 between the interior surface 24 of the receptacle 10 and the inserts 26, 28.

FIG. 4A is a partial cross sectional view schematic representation of the pressed-in receptacle annular ring of FIG. 4. The receptacle 10 has inscribed surface groove 22 wherein annular ring 44 is pressed. The open area 51 within the space formed by the interior surface 24 of the receptacle 10 and the insert 26 is blocked by the top 53 of the ring 44. The pressing of the ring 44 results in the compression of ring 44 forwardly against a rearwardly facing surface or ledge defined by an enlarged diameter portion of insert 28, and of the interior surface 47 of the ring against the exterior surface of the insert and the exterior surface 49 against the bottom surface of annular groove 22. The compressed ring 44 provides support to the inserts where they mate at bonded interface 39 wherein the bottom 33 of the first insert 26 is joined to the top 35 of the second insert 28. The annular ring 44 is shown in relation to the exterior surface 50 of the receptacle 10 and first threaded means 40.

FIG. 5 is a schematic representation partial cross sectional view of the connector plug and coupling nut having insert view B. The plug 12 has a top 52 and bottom 54. The coupling nut 14 is shown matingly engaged to the plug 12 by coupling nut retaining ring 80, and the receptacle 10 second threaded means 42 (FIG. 4). Electrical wires (not shown), are operable to enter the second plug insert cavity 74 and be electrically connected to the female electrical contact 102 having either crimped or soldered terminations. A receptacle connector having metal pins 38 when matingly engaged with the plug connector transmit electrical signals from the pins 38 which enter the plug through holes 101 to the female contacts 102 within the first insert cavity 72. The gas tight seal within the plug connector is accomplished by first inscribing an annular groove 62 within the interior surface 58 of the plug 12. An annular plug ring 64 of a soft metal is then slidably interfit around the second insert means 70 and the interior surface 58 of the plug. A metal tool, similar to tool 84 of FIG. 2, impresses and compresses the annular plug ring 64 within the inscribed groove 62 providing mechanical support for the bonded-together first and second inserts 68, 70. An O-ring 95 serves as a secondary seal when it is placed between the coupling nut 14 and plug within the annular side flange 60. It is an industry standard in some connectors to bond the O-ring 95 within the front of the shell of the plug connector.

FIG. 5B is a schematic representation partial cross sectional view of the secondary seal between the connector plug and the coupling nut of FIG. 5 The plug 12 with exterior 56 has an annular side flange 60 of the plug 12. The O-ring 95 fits within the flange 60 between the annular sealing edge 48 of the receptacle 10, sealing between the interior of the front of receptacle 10 and the exterior of the front of plug 12. The interior 58 of the plug 12 rests against the first 68 and second 70 insert means due to a force fitting relationship. This O-ring 95 serves as a secondary seal for the open area 110 between the mating surfaces of the receptacle 10 and plug 12.

Whenever the inserts as shown in these figures are moved, or the insert retaining rings are under tension through vibrational forces, the work-hardened metal of the annular rings provide a fully formed connector support structure which gives the inserts increased mechanical support.

A method of providing this gas tight seal for the retainage of the insert, includes: the grooving of the interior surface of the receptacle and plug, the insertion of a separate annular ring of aluminum or other annealed soft metal, placing around the inserts within the receptacle and plug rings a tool, compressing and collapsing the soft annealed ring into a position surrounding the insert providing a gas tight free seal to support the insert. The completed seal appears as one complete unit of the ring and housing.

Connectors of industrial quality having high durability and structural stability are developed using this system.

While particular embodiments of the invention have been shown and described, it will be obvious to those skilled in the art that changes and modifications may be made without departing from the invention in its broader aspects and therefore the aim and the appended claims is to cover all such changes and modifications as followed in the true spirit and scope of the invention.

What is claimed:

1. A method of providing an insert retention means for an electrical connector, said method comprising:

providing an electrical connector said electrical connector having a receptacle, plug and coupling nut, said receptacle and said plug having inserts;

providing at least one annular groove inscribed within the interior surface of said receptacle and said plug;

providing at least one soft metal annular ring operable to slidably interfit between said receptacle insert and said plug insert and said interior walls of said plug and said receptacle, said soft metal annular ring residing within said annular grooves; and providing a beveled cylindrical tool, said bevelled cylindrical tool operable to slidably interfit between said interior surface of said receptacle and exterior surface of said plug and said receptacle and plug insert means, said bevelled cylindrical tool operable to compress and collapse said soft metal annular ring within said annular grooves when said bevelled cylindrical tool is subjected to a high force.

2. A method of providing an insert retention gas seal for an electrical connector, comprising the steps of:

providing an electrical connector, said electrical connector having a receptacle, plug and coupling nut said electrical connector further comprising at least one insulating insert slidably interfitting and cooperatively associated within said receptacle and said plug of said electrical connector;

providing at least one annular groove inscribed within the interior surface of said receptacle and said plug, said annular groove inscribed approximate to and cooperatively associated with said insulating inserts;

providing at least one soft annealed metal cylindrical ring, said soft annealed mutual cylindrical ring operable to be slidably interfit within said annular grooves between said insulating insert and said interior surfaces of said receptacle and said plug; and providing a hard metal, bevelled edged cylindrical tool, said hard metal bevelled edged cylindrical tool having the same annulus as said soft annealed metal cylindrical ring, said hard metal bevelled edged cylindrical tool operable to slidably interfit between said insulating inserts of said receptacle and said plug and said interior surfaces of said receptacle and said plug resting upon said soft annealed metal cylindrical ring such that force applied to said hard metal bevelled edged cylindrical tool compresses and collapses said soft annealed metal cylindrical ring within said annular groove.

3. A method of providing an insert retainage system for an electrical connector, comprising the steps of:

grooving the interior surface of said electrical connector receptacle and said electrical connector plug;

inserting between an insulating insert and said interior surface of said electrical connector receptacle and said electrical connector plug a soft metal cylindrical ring, said soft metal cylindrical ring resting within the groove inscribed within said interior surface of said electrical connector receptacle and said electrical connector plug; and compressing said soft metal cylindrical ring with a hard metal bevelled edged tool such that said soft metal cylindrical ring is compressed under a force approximately in the range of 100 to 150 psi within said groove inscribed within said interior surface of said electrical connector receptacle and said electrical connector plug.

* * * * *